US009027703B2

(12) United States Patent
Masor

(10) Patent No.: US 9,027,703 B2
(45) Date of Patent: May 12, 2015

(54) ACOUSTIC CONTAINER

(71) Applicant: Randall Masor, Houston, TX (US)

(72) Inventor: Randall Masor, Houston, TX (US)

( * ) Notice: Subject to any disclaimer, the term of this patent is extended or adjusted under 35 U.S.C. 154(b) by 132 days.

(21) Appl. No.: 13/941,143

(22) Filed: Jul. 12, 2013

(65) Prior Publication Data

US 2015/0014090 A1 Jan. 15, 2015

(51) Int. Cl.

| | |
|---|---|
| ***G10D 13/06*** | (2006.01) |
| ***B65D 1/44*** | (2006.01) |
| ***B65D 1/02*** | (2006.01) |
| ***G10K 11/18*** | (2006.01) |

(52) U.S. Cl.

CPC ..... *B65D 1/44* (2013.01); *B65D 1/0284* (2013.01); *G10K 11/18* (2013.01)

(58) Field of Classification Search

CPC ..... G10D 13/06
USPC ..... 181/211; 215/383; 84/402, 403, 404, 84/405, 406, 407, 408, 409, 410
See application file for complete search history.

(56) References Cited

U.S. PATENT DOCUMENTS

| | | | | |
|---|---|---|---|---|
| 3,319,507 | A * | 5/1967 | Wolcott | 84/375 |
| 5,130,696 | A | 7/1992 | Liebman | |
| 6,299,006 | B1 * | 10/2001 | Samonek | 215/307 |
| 6,302,813 | B1 * | 10/2001 | Sturgeon et al. | 473/564 |
| 6,335,691 | B1 * | 1/2002 | Bird | 340/691.1 |
| 8,136,684 | B2 * | 3/2012 | Becotte | 215/386 |
| 8,492,632 | B1 * | 7/2013 | Doe | 84/406 |
| 8,558,715 | B2 * | 10/2013 | Lien et al. | 340/691.1 |
| 2004/0206224 | A1 * | 10/2004 | Cohen | 84/410 |

FOREIGN PATENT DOCUMENTS

| | | |
|---|---|---|
| WO | WO 02/076855 | 10/2002 |
| WO | WO 2006/110559 | 10/2006 |

* cited by examiner

*Primary Examiner* — Forrest M Phillips

(57) ABSTRACT

Methods and devices are disclosed for a gaseous liquid to audibly deform the shape of a closed container. One embodiment includes pushing inward to depress a plurality of deformations integral with an exterior of the plastic container having a bottom, a top, the exterior, and an interior, wherein the top is at least partially opened. Further, the method includes sealing, subsequent to the depressing, the top to close the plastic container. Further still, the method includes pushing outward, subsequent to the sealing, by carbonation from a carbonated liquid contained within the interior, on the plurality of deformations. Yet further, the method includes deforming, by the pushing outward, at least two of the plurality of deformations to displaced positions. The method also includes creating two or more sounds and/or movement by the deforming.

24 Claims, 2 Drawing Sheets

ACOUSTIC CONTAINER

FIELD OF DISCLOSURE

This disclosure generally relates to acoustic containers. More particularly, this disclosure relates to devices and methods involving a gaseous liquid that audibly deforms the shape of a closed container.

BACKGROUND

Gaseous liquids in containers, such as carbonated beverages in plastic bottles, are ubiquitous. These containers may be seen in grocery and convenient stores and often hold our favorite beverages, such as Coca-Cola®, Pepsi®, Ale 81®, Orangina®, root beers, mineral water, sparkling wine, and beer. Although these containers slightly vary in shape, their shape is largely relegated to containing the gaseous liquid therein. That is, these containers substantially comprise a tapered-bottle shape with minimalistic departures, if any, in the form of ridges, grooves or accentuated curvatures on the container. To that end, these departures merely impart ornamentality to the container.

SUMMARY OF THE INVENTION

In one embodiment, a method includes pushing inward to depress one or more arranged deformations integral with an exterior of the plastic container having a bottom, a top, the exterior, and an interior, wherein the top is at least partially opened. Further, the method includes sealing, subsequent to the depressing, with a cap on the top to close the plastic container. Further still, the method includes pushing outward, subsequent to the sealing, by carbonation from a carbonated liquid contained within the interior, on at least one of the one or more arranged deformations. Yet further, the method includes deforming, by the pushing outward, of the at least one of the one or more arranged deformations to a maximum position, and then creating one or more sounds by the deforming.

In another embodiment, the device includes a bottom, a top, an exterior, and an interior, wherein the bottom at least has a capacity to rest on a substantially flat surface when the plastic container is opened at the top. Further, the device includes a removable seal for engaging with the top. Further still, the device includes a plurality of arranged deformations integral with the exterior, wherein the arranged deformations have a capacity to audibly deform upon pressure from carbonation contained within the interior when the plastic container is closed.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this disclosure and are therefore not to be considered limiting of its scope, for the disclosure may admit to other equally effective embodiments.

DETAILED DESCRIPTION OF THE EMBODIMENTS

The following is a detailed description of example embodiments of the invention depicted in the accompanying drawings. The embodiments are examples and are in such detail as to clearly communicate the invention. However, the amount of detail offered is not intended to limit the anticipated variations of embodiments; on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

In addition, directional terms, such as "above," "below," "upper," "lower," "front," "back," "top," "bottom," etc., are used for convenience in referring to the accompanying drawings. In general, "above," "upper," "upward," "top," and similar terms refer to a direction away the earth's surface, and "below," "lower," "downward," "bottom," and similar terms refer to a direction toward the earth's surface, but is meant for illustrative purposes only, and the terms are not meant to limit the disclosure.

Figure 1:
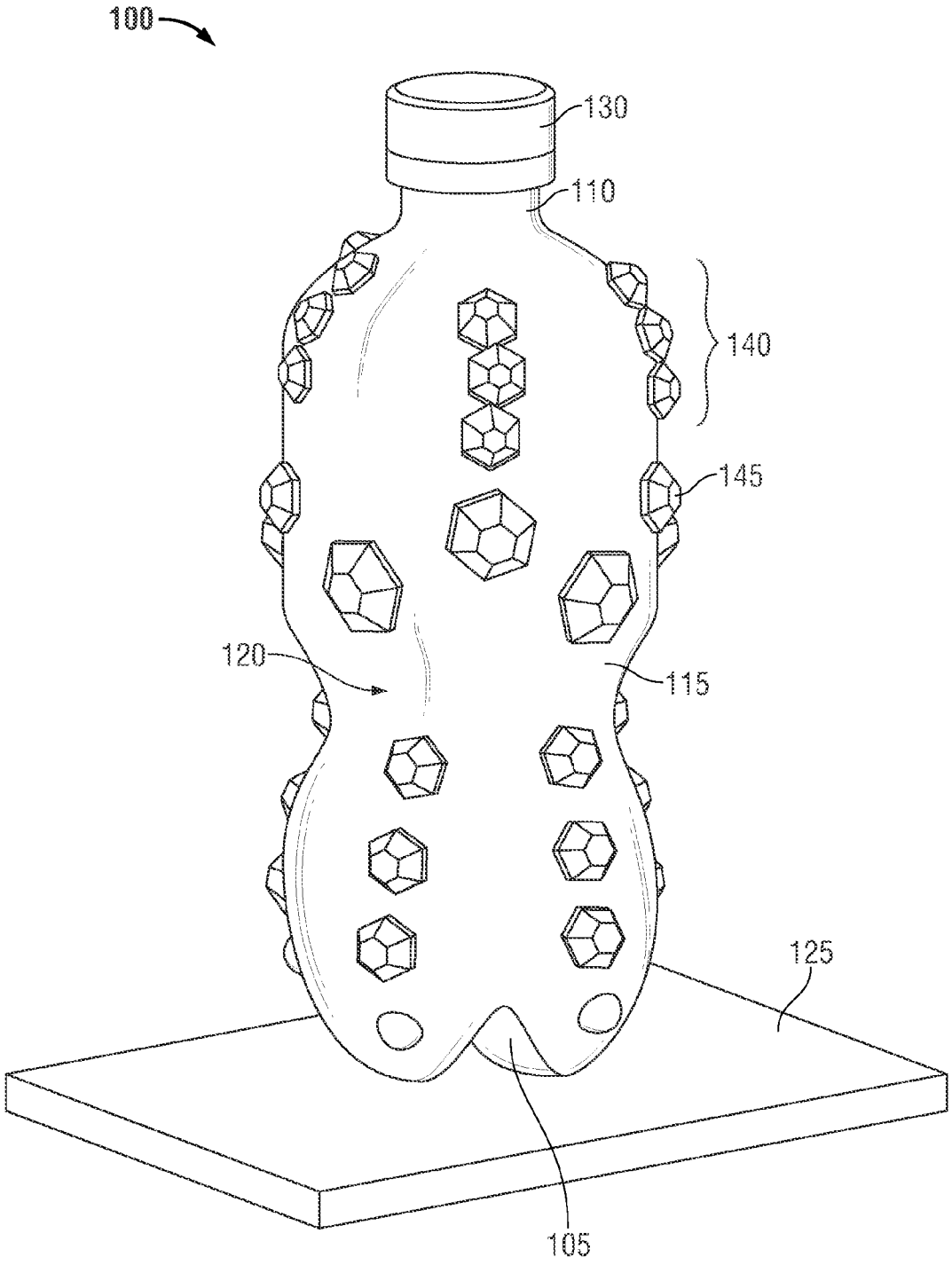
FIG. 1 depicts an overview of a plastic container in accordance with the disclosed devices and methods.

Generally disclosed are devices and methods involving carbonation within a carbonated liquid that causes two or more depressed deformations in a plastic container to make sounds when transitioning to non-depressed positions. Turning now to FIG. 1, an example embodiment of this general disclosure helps to explain the plastic container 100 contemplated by this disclosure. FIG. 1 shows a plastic container 100, which, in common parlance, may be a soda-pop bottle. By way of other, non-limiting examples, the plastic container 100 may have a shape customarily seen for a keg of beer or a gallon of milk. Regardless of the particular shape, the plastic container 100, whether polyethylene terephthalate or otherwise, has a bottom 105, top 110, exterior 115, interior 120, and removable seal 130, such as a screwable cap, which engages with the top 110 in order to close the plastic container 100, possibly a type 100 often seen containing a consumable, carbonated beverage. In addition, the plastic container 110 may be designed to rest on a substantially flat surface 125, such as a table or desk, when the plastic container 100 is opened, closed, or both.

Whether the plastic container 100 is manufactured through a plastics extrusion, molding or other commercial process, it 100 may have a plurality of deformations integral with the exterior 115, wherein FIG. 1 depicts an example subset 145 of a plurality of deformations. During the manufacturing process, each 145 of the deformations may have a regular or irregular shape. For example, all or some of the deformations 145 having a regular shape may be circular, ellipsoidal, or paragonal, e.g., square, hexagon, etc. In conjunction with or instead of having deformations 145 with regular shapes on the plastic container 100, all or some of the deformations 145 may have an irregular shape. Examples of irregular shapes include any non-regular shape as well as deformations 145 that are multi-deformed. A multi-deformed shape may be a deformation 145 consisting of a hexagon having a smaller-sized square on top of the hexagon, a rectangular base having a smaller-sized circular shape on top, and so forth. In sum, multi-deformed shapes may be thought of as a bump that is located on a larger bump, regardless of the identity of its constituent shapes.

In concert with the particular shape of each 145 deformation, a size of each 145 also affects the pitch of the sounds to emanate from the sealed 130 plastic container 100 when carbonation from a carbonated liquid located within the interior 120 at least partially expands one or more of the plurality (e.g., subset 140) of deformations that are depressed. The size of each 145 of the deformations may vary in length and width along the exterior 115 as well as vary in depressable depth (or expandable height when viewed contrariwise).

Furthermore, the plurality of deformations may have regular or irregular patterns when globally or locally viewing the plastic container 100. For instance, global and local regular patterns exist in FIG. 1. Three deformations in a vertical line appear as a local pattern in a set 140 of deformations. Globally, along an upper row of the plastic container 100 containing the set 140, two more sets of three deformations in a vertical line are depicted. And, from an even more global perspective, the plastic container can be seen as a collection of three rows, wherein the upper row contains the aforementioned three sets of three deformations in a vertical line, the middle row contains a repeated pattern of a lower and then higher deformation of different size as compared to the upper row's deformations, and a bottom row of three deformations in a vertical line, wherein the spaces between the respective deformations in the bottom row's deformations is larger than the respective deformations in the upper row's deformations. Although the foregoing discussion exemplified regular patterns from both a local and global perspective, in other example embodiments, greater or fewer regular patters may exist at either or both the local or global level. And, in yet further example embodiments, there may be no regular pattern, i.e., an irregular pattern, of deformations integral with the exterior 115 of the plastic container 100.

By selecting the size, shape, and placement of each 145 of the deformations during the forming (e.g., extruding or molding) process of the plastic container 100, a degree of control exists over the quality and quantity of sounds that arise when carbonation from a carbonated liquid acts to at least partially expand one or more depressed deformations of the at least partially sealed 130 plastic container 100. For instance, depending on other parameters such as temperature, volume and viscosity of the carbonated liquid in the plastic container 100, as well as carbonation concentration, the number of sounds that may arise at least partially depends on the number of depressed deformations that at least partially expand. By way of expanding these depressed deformations, the sounds may be random and/or rhythmic, such as a riff, a scale or part thereof, a few notes of a tune, etc. To this point, the manufacturer of the plastic container 100 may select the arrangement, i.e., the size, shape, and placement of each 145 of the deformations, in order to achieve a desired collection of sounds for the plastic container 100 to make after carbonation acts on particular depressed deformations. Additionally or alternatively, the manufacturer of the plastic container 100 may select the arrangement of the deformations in order to achieve a desired movement of the plastic container 100. For instance, at least partial expansion of one or more depressed deformations located on the bottom 105 of the plastic container 100 may cause the plastic container 100 to topple, or, effectively, dance a little.

Figure 2:
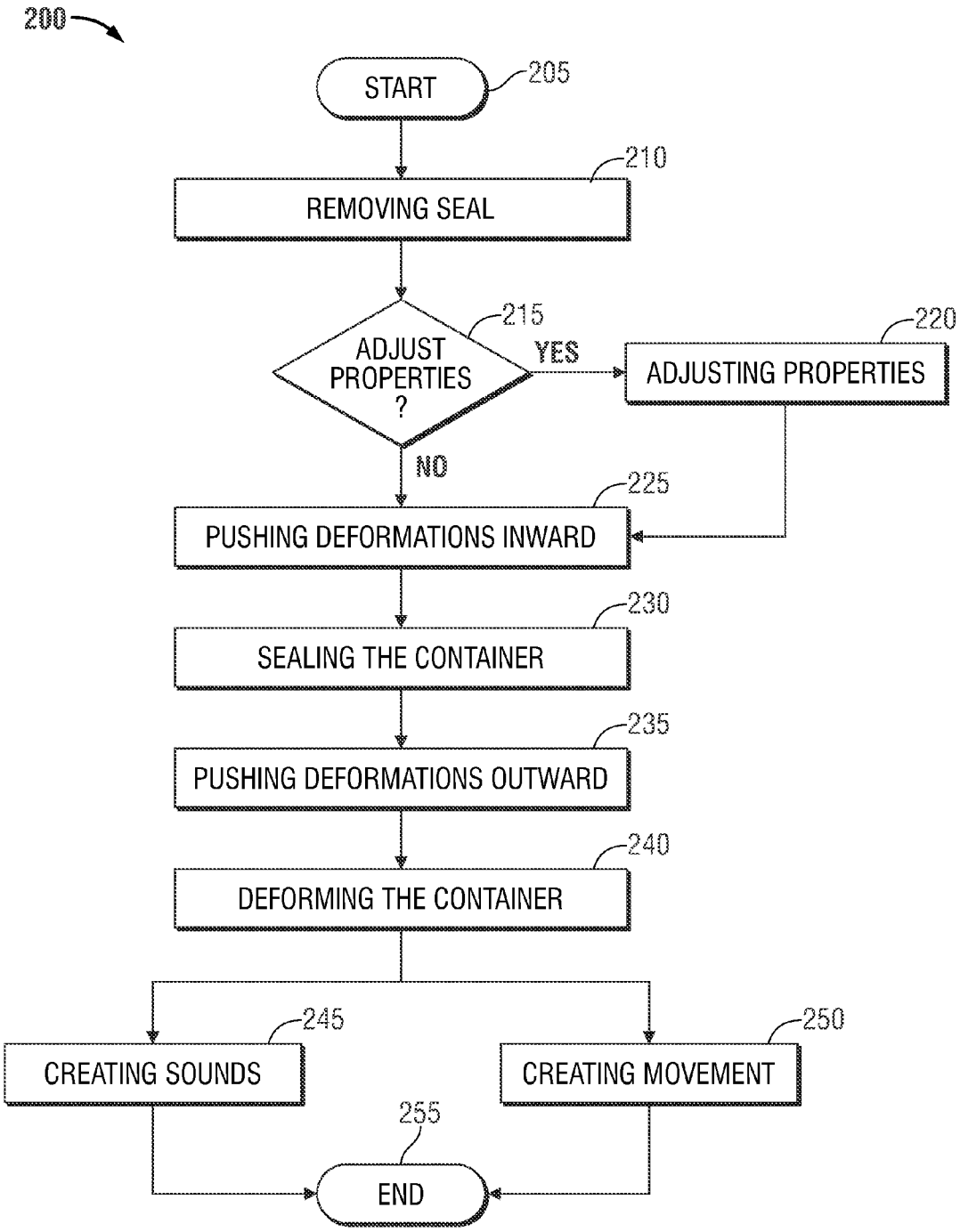
FIG. 2 depicts an example embodiment of a flowchart for creating sounds with a plastic container in accordance with the disclosed devices and methods.

Moving on to FIG. 2, another aspect of the disclosure is presented. FIG. 2 depicts an example embodiment of methods contemplated by this disclosure in the form of a flowchart 200. Flowchart 200 starts 205 by removing 210 the seal of the plastic container. The flowchart 200 continues by querying 215 whether to adjust the properties of the carbonated liquid already within or to be placed within the interior of the plastic container. If yes, one example parameter for adjusting 220 includes raising or lowering the temperature of the carbonated liquid, wherein, solubility of the dissolved carbonation is typically inversely proportional to temperature. Other example, adjustable 220 parameters include directly raising or lowering the concentration of the carbonation, raising or lowering the viscosity of the liquid, and raising or lowering the volume of the carbonated liquid. Adjusting 220 these parameters affects the rate and amount of carbonation available to escape the liquid and act on the depressed deformations. In other, non-depicted, example embodiments, adjusting 220 the parameters may occur after the plastic container is sealed.

If the answer is no to the query 215, or, if merely subsequent to optionally adjusting 220 the parameters, then the flowchart 200 continues by pushing 225 deformations inward. Here, a plurality of deformations integral to the exterior of the plastic container are at least partially pushed 225 inward, such as with fingers or a pushing instrument. Each of the deformations, regardless of location, shape, or size is reversible. As such, the arranged deformations may be pushed 225 inward or, later, be pushed 235 outward, at the same maximum distance but in opposite directions. Positions between these maxima are also possible and are the result of partially depressing 225 inward or partially depressing 235 outward.

Subsequent to pushing 225 the deformations inward, the container is sealed 230. In other embodiments, pushing 225 the deformations inward may occur when the container is partially sealed or completely sealed. Nevertheless, the flowchart 200 continues by pushing 235 outward on a plurality of deformations by the carbonation from the carbonated liquid within the interior of the plastic container. The pushing 235 outward may deform 240 at least two of the plurality of deformations to displaced positions. In line with previous discussion, the displaced positions, themselves, may be anywhere along the spectrum from partial to full expansion from the depressed positions. By deforming 240 at least two of the plurality of deformations, whether fully or partially back to the original position prior to pushing 225 inward, the deforming 240 may create 245, 250 sound and/or movement as previously discussed. The creating 245, 250 depends on the location, size, and shape of the at least two of the plurality of deformations being deformed 240. That is, alongside adjusting 220 parameters, the creating 245, 250 depends on the manufactured arrangement of the reversible deformations on the plastic bottle. Thereafter, the flowchart 200 ends 255.

While the foregoing is directed to example embodiments of the disclosed invention, other and further embodiments of the invention may be devised without departing from the basic scope thereof, and the scope thereof is determined by the claims that follow.

What is claimed is:

1. A plastic container comprising:

a bottom, a top, an exterior, and an interior, wherein the bottom at least has a capacity to rest on a substantially flat surface when the plastic container is opened at the top;

a removable seal for engaging with the top; and a plurality of deformations integral with the exterior, wherein the deformations have a capacity to deform with sounds upon pressure from carbonation contained within the interior when the plastic container is closed, wherein at least partial expansion, contraction, or combination thereof of an arrangement of shapes and sizes of the deformations affects pitches of the sounds emanating from the plastic container to create rhythmic sounds.

2. The plastic container of claim 1, wherein the plastic container comprises a bottle shape.

3. The plastic container of claims 1, wherein the plastic container comprises a keg shape.

4. The plastic container of claim 1, wherein the plastic container comprises a gallon-milk-jug shape.

5. The plastic container of claim 1, wherein the removable seal comprises a screwable cap for sealably engaging with the top.

6. The plastic container of claim 1, wherein the plurality of deformations comprises the arrangement having one or more of the shapes along the exterior, wherein the one or more shapes is selected form a type consisting of regular, irregular, and combinations thereof.

7. The plastic container of claim 1, wherein the plurality of deformations comprises the arrangement having one or more of the sizes along the exterior, wherein the one or more sizes may vary in length, width and depth.

8. The plastic container of claim 1, wherein the plurality of deformations comprises a pattern along the exterior, wherein the pattern is selected from a type consisting of regular, irregular, and combinations thereof.

9. The plastic container of claim 1, wherein the carbonation exists in a liquid contained within the interior.

10. The plastic container of claim 1, wherein the capacity to deform with sounds comprises full expansion of the one or more of the deformations concomitant with creation of the rhythmic sounds.

11. The plastic container of claim 1, wherein the pressure from the carbonation on one or more of the plurality of deformations located on the exterior of the bottom topples the plastic container.

12. A method for creating a plastic container that makes rhythmic sounds, the method comprising: forming a plurality of reversible deformations integral with an exterior of the plastic container having a bottom, a top, an exterior, and an interior;

providing a seal to sealingly engage with the top, and wherein, carbonation, in a carbonated liquid located within the interior, deforms and causes the rhythmic sounds when at least two of the plurality of the reversible deformations, having an arrangement of shapes and sizes that affect pitches of the rhythmic sounds emanating from the plastic container, are in transition from depressed positions to non-depressed positions while the seal is secured to the top.

13. The method of claims 12, wherein the forming comprises extruding plastic.

14. The method of claim 12, wherein the forming comprises molding.

15. The method of claim 12, further comprising arranging location, size, and shape of each of the plurality of reversible deformations.

16. The method of claim 15, wherein the arranging affects pitch of the sounds.

17. A method for creating rhythmic sounds from a plastic container, comprising:

pushing inward to depress a plurality of deformations, having an arrangement of locations, shapes and sizes that affect pitches of the rhythmic sounds emanating from the plastic container, wherein the deformations are integral with an exterior of the plastic container having a bottom, a top, the exterior, and an interior, wherein the top is at least partially opened;

sealing, subsequent to the depressing, the top to close the plastic container; pushing outward, subsequent to the sealing, by carbonation from a carbonated liquid contained within the interior, on the plurality of deformations;

deforming, by the pushing outward, at least two of the plurality of deformations to displaced positions; and creating two or more rhythmic sounds by the deforming.

18. The method of claim 17, further comprising, prior to the pushing inward, at least partly removing a seal from the top.

19. The method of claim 17, further comprising affecting a rate of the creating based on adjusting one or more properties of the carbonated liquid in the interior, wherein the parameters are selected from a group consisting of temperature, concentration, volume, and viscosity.

20. The method of claim 17, further comprising moving the plastic container by the deforming.

21. The method of claim 17, wherein the pushing inward comprises pushing with one or more fingers.

22. The method of claim 17, wherein the pushing inward comprises pushing to a position having an opposite direction from the displaced positions.

23. The method of claim 17, wherein the creating depends on the locations, sizes, and shapes of each of the at least two of the plurality of the deformations.

24. The method of claim 17, wherein the creating comprises creating a riff.

* * * * *